US008648783B2

(12) United States Patent
Baek et al.

(10) Patent No.: US 8,648,783 B2
(45) Date of Patent: Feb. 11, 2014

(54) APPARATUS AND METHOD FOR DRIVING LIQUID CRYSTAL DISPLAY

(75) Inventors: Jong Sang Baek, Kumi (KR); Sun Young Kwon, Kumi (KR)

(73) Assignee: LG Display Co., Ltd., Seoul (KR)

( * ) Notice: Subject to any disclaimer, the term of this patent is extended or adjusted under 35 U.S.C. 154(b) by 2286 days.

(21) Appl. No.: 10/951,693

(22) Filed: Sep. 29, 2004

(65) Prior Publication Data

US 2005/0073494 A1 Apr. 7, 2005

(30) Foreign Application Priority Data

Oct. 2, 2003 (KR) ..... 10-2003-0068762

(51) Int. Cl.
*G09G 3/36* (2006.01)

(52) U.S. Cl.
USPC ..... 345/94; 345/88; 345/98

(58) Field of Classification Search
USPC ..... 324/770; 345/87–89, 94, 98–100, 690
See application file for complete search history.

(56) References Cited

U.S. PATENT DOCUMENTS 5,153,574 A * 10/1992 Kondo ..... 345/550
5,270,687 A * 12/1993 Killebrew, Jr. ..... 345/602
5,790,096 A * 8/1998 Hill, Jr. ..... 345/600
6,046,737 A * 4/2000 Nakamura ..... 345/213
6,265,889 B1 * 7/2001 Tomita et al. ..... 324/765
6,392,629 B1 * 5/2002 Murakami et al. ..... 345/98
6,618,089 B1 * 9/2003 Tamayama ..... 348/333.13
6,927,767 B1 * 8/2005 Ouchi ..... 345/213
2002/0105511 A1 * 8/2002 Ito ..... 345/211
2004/0061675 A1 * 4/2004 Hirakawa et al. ..... 345/88

FOREIGN PATENT DOCUMENTS

JP 4-276790 10/1992
JP 9-218670 8/1997

* cited by examiner

*Primary Examiner* — Quan-Zhen Wang
*Assistant Examiner* — Calvin C Ma
(74) *Attorney, Agent, or Firm* — McKenna, Long & Aldridge, LLP

(57) ABSTRACT

A driving apparatus and a method for a liquid crystal display wherein a picture can be inspected by a specific image signal when an image signal is not applied is provided. In the driving apparatus, an image signal processor extracts a complex synchronizing signal and a first image signal from a complex image signal input from an external source. An image signal generator generates a second image signal. An input signal detector counts the pulses in the complex synchronizing signal to generate a selection signal. An image signal selector selectively outputs any one of the first image signal from the image signal processor and the second image signal from the image signal generator in response to the selection signal. A data driver applies an output image signal selected and output by the image signal selector to the liquid crystal display panel.

16 Claims, 10 Drawing Sheets

APPARATUS AND METHOD FOR DRIVING LIQUID CRYSTAL DISPLAY

This application claims the benefit of Korean Patent Application No. P2003-68762 filed in Korea on Oct. 2, 2003, which is hereby incorporated by reference.

BACKGROUND OF THE INVENTION

1. Field of the Invention

This invention relates to a liquid crystal display, and more particularly to a driving apparatus and method for a liquid crystal display wherein a picture may be inspected by a specific image signal when an image signal is not applied.

2. Description of the Related Art

Generally, a liquid crystal display (LCD) of an active matrix driving system uses thin film transistors (TFT's) as switching devices to display a natural moving picture. Because this type of LCD can have a smaller size than a Brown tube, they have been widely used in monitors for personal or notebook computers as well as office automation equipment such as a copy machine, etc. and portable equipment such as a cellular phone or a pager, etc.

The active matrix LCD displays a picture corresponding to video signals, such as television signals, on a picture element matrix or pixel matrix having liquid crystal cells arranged at intersections between gate lines and data lines. The thin film transistor is provided at each intersection between the gate lines and the data lines thereby switching a data signal to be transmitted into the liquid crystal cell in response to a scanning signal (or gate pulse) from the gate line.

LCDs may display either NTSC signals and/or PAL signals.

Generally, if an NTSC signal (i.e., 525 vertical lines) is input, a horizontal resolution of the LCD is expressed in accordance with a number of sampled data while a vertical resolution thereof is expressed by a 234 line de-interlace scheme. On the other hand, if a PAL signal (i.e., 625 vertical lines) is input, the horizontal resolution of the LCD is expressed in accordance with a number of sampled data while a vertical resolution thereof is modified using a processing system to produce a NTSC signal in which one line is removed for each six vertical lines which results in 521 lines.

Referring to FIG. 1, a conventional LCD driving apparatus includes a liquid crystal display panel 30 having liquid crystal cells arranged in a matrix a gate driver 34 for driving gate lines GL of the liquid crystal display panel 30, and a data driver 32 for driving data lines DL of the liquid crystal display panel 30. The LCD driving apparatus also includes an image signal processor 10 for extracting a complex synchronizing signal Csync and red, green and blue image signals R_Video, G_Video and B_Video from an NTSC complex image signal. The image signal processor also functions to apply the red, green and blue image signals R_Video, G_Video and B_Video to the data driver 32 and output the complex synchronizing signal Csync. In addition, the LCD driving apparatus has a controller 20 for receiving the complex synchronizing signal Csync from the image signal processor 10 to generate a data control signal DCS for controlling the data driver 32 and a gate control signal GCS for controlling the gate driver 34. The controller 20 also functions to apply the DCS and the GCS to the data driver 32 and the gate driver 34, respectively.

The liquid crystal display panel 30 includes liquid crystal cells arranged in a matrix and thin film transistors TFT provided at intersections between the gate lines GL and the data lines DL which connect to the liquid crystal cells.

The thin film transistor TFT is turned on when a scanning signal, such as a gate high voltage VGH from the gate line GL is applied, thereby applying a pixel signal from the data line DL to the liquid crystal cell. On the other hand, the thin film transistor TFT is turned off when a gate low voltage VGL is applied from the gate line GL, thereby maintaining a pixel signal charged in the liquid crystal cell.

The liquid crystal cell can be modelled as a liquid crystal capacitor LC and includes a pixel electrode connected to a common electrode and a thin film transistor TFT opposed to the electrodes with a liquid crystal disposed there between. Further, the liquid crystal cell includes a storage capacitor Cst for stably maintaining the charged pixel signal until the next pixel is charged. The storage capacitor Cst is provided between a pre-stage gate line and the pixel electrode. Such a liquid crystal cell varies an alignment state of the liquid crystal having a dielectric anisotropy in response to the pixel signal charged via the thin film transistor TFT to control a light transmittance, thereby implementing a gray scale level.

The image signal processor 10 converts the complex image signal NTSC supplied from the exterior thereof into red, green and blue image signals R_Video, G_Video and B_Video such that the signals are suitable for driving the liquid crystal display panel 30. The image signal processor 10 also applies the signals to the data driver 32, and extracts the complex synchronizing signal Csync from the complex image signal NTSC and applies the complex synchronizing signal Csync to the timing controller 20.

The timing controller 20 generates a horizontal synchronizing signal Hsync, a vertical synchronizing signal Vsync and a dot clock Dclk using the complex synchronizing signal Csync from the image signal processor 10 and applies both signals to the data driver 32. Further, the timing controller 20 generates a data control signal DCS for controlling the drive timing of the data driver 32 and applies the data control signal DCS to the data driver. The timing controller 20 also generates a gate control signal GCS for controlling the drive timing of the gate driver 34 and applies the gate control signal GCS to the gate driver 34 with the aid of the horizontal synchronizing signal Hsync, the vertical synchronizing signal Vsync and the dot clock Dclk.

The gate driver 34 sequentially applies the gate high voltage VGH to the gate lines GL in response to gate control signals GSP, GSC and GOE from the timing controller 20. Thus, the gate driver 34 allows the thin film transistors TFT connected to the gate lines GL to be driven for each gate line.

More specifically, the gate driver 34 shifts a gate start pulse GSP in response to a gate shift pulse GSC to generate a shift pulse. Further, the gate driver 34 applies the gate high voltage VGH to the corresponding gate line GL every horizontal period H1, H2, . . . in response to the shift pulse. Here, the gate driver 34 applies the gate high voltage VGH only in an enable period in response to a gate output enable signal GOE. On the other hand, the gate driver 34 applies the gate low voltage VGL in the remaining period when the gate high voltage VGH is not applied to the gate lines GL.

The data driver 32 applies pixel data signals for each line to the data lines DL every horizontal period H1, H2, . . . in response to the horizontal synchronizing signal Hsync, the vertical synchronizing signal Vsync, the dot clock Dclk and data control signals SSP, SSC and SOE from the timing controller 20 as shown in FIG. 2. Particularly, the data driver 32 converts the red, green and blue image signals R_Video, G_Video and B_Video from the image signal processor 10 into analog data and applies the image signals to the data lines DL.

More specifically, the data driver 32 shifts a source start pulse SSP from the timing controller 20 in response to a source shift clock SSC to generate a sampling signal. Then, the data driver 32 sequentially inputs the red, green and blue image signals R_Video, G_Video and B_Video for a certain unit in response to the sampling signal thereby latching the image signals. Further, the data driver 32 applies the latched analog data for one line to the data lines DL.

Meanwhile, a panel aging process for displaying a specific image signal on the completed LCD is carried out during a fabrication process of the LCD. During the panel aging process, as shown in FIG. 2, the data driver 32 is supplied with the red, green and blue image signals R_Video, G_Video and B_Video and the data control signals from the timing controller 20. Thus, the liquid crystal display panel 30 displays a picture corresponding to the red, green and blue image signals R_Video, G_Video and B_Video.

However, if the red, green and blue image signals R_Video, G_Video and B_Video are not applied to the data driver 32 during the panel aging process, then a black screen only is displayed on the liquid crystal display panel 30 because each of the red, green and blue image signals R_Video, G_Video and B_Video is set to a ground level. Therefore, the conventional LCD driving apparatus has a problem because it is impossible to make a picture inspection for the liquid crystal display panel 30 when the red, green and blue image signals R_Video, G_Video and B_Video are not applied to the data driver 32. Furthermore, the conventional LCD driving apparatus has a problem in that, since it is necessary to apply the red, green and blue image signals R_Video, G_Video and B_Video to the LCD during the panel aging process, it is impossible to detect whether or not the red, green and blue image signals R_Video, G_Video and B_Video are input. As a result, it becomes difficult to set panel aging equipment.

SUMMARY OF THE INVENTION

Accordingly, it is an advantage of the present invention to provide a driving apparatus and method for a liquid crystal display wherein a picture can be inspected by a specific image signal when an image signal is not applied.

Yet another advantage of the present invention is to provide a driving apparatus and method for a liquid crystal display wherein a picture can be inspected by a specific image signal when an image signal is not applied, thereby shortening fabrication process times such as aging process times and the like.

In order to achieve these and other advantages of the invention, a driving apparatus for a liquid crystal display according to one aspect of the present invention includes: a liquid crystal display panel; an image signal processor that extracts a complex synchronizing signal and a first image signal from a complex image signal; an image signal generator that generates a second image signal; an input signal detector that counts pulses in the complex synchronizing signal to generate a selection signal; an image signal selector that selectively outputs one of the first image signal from the image signal processor and the second image signal from the image signal generator in response to the selection signal; and a data driver that applies the selected output image signal to the liquid crystal display panel.

A method of driving a liquid crystal display according to another aspect of the present invention includes: extracting a complex synchronizing signal and a first image signal from a complex image signal; generating a second image signal; counting the number of pulses in the complex synchronizing signal to generate a selection signal; selecting one of the first image signal and the second image signal in response to the selection signal using an image signal selector; and applying one of the first selected image signal and the selected second image signal, via a data driver, to a liquid crystal display panel.

BRIEF DESCRIPTION OF THE DRAWINGS

These and other advantages of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, embodiments of the present invention will be described in detail with reference to FIGS. 3 to 7.

Figure 1:
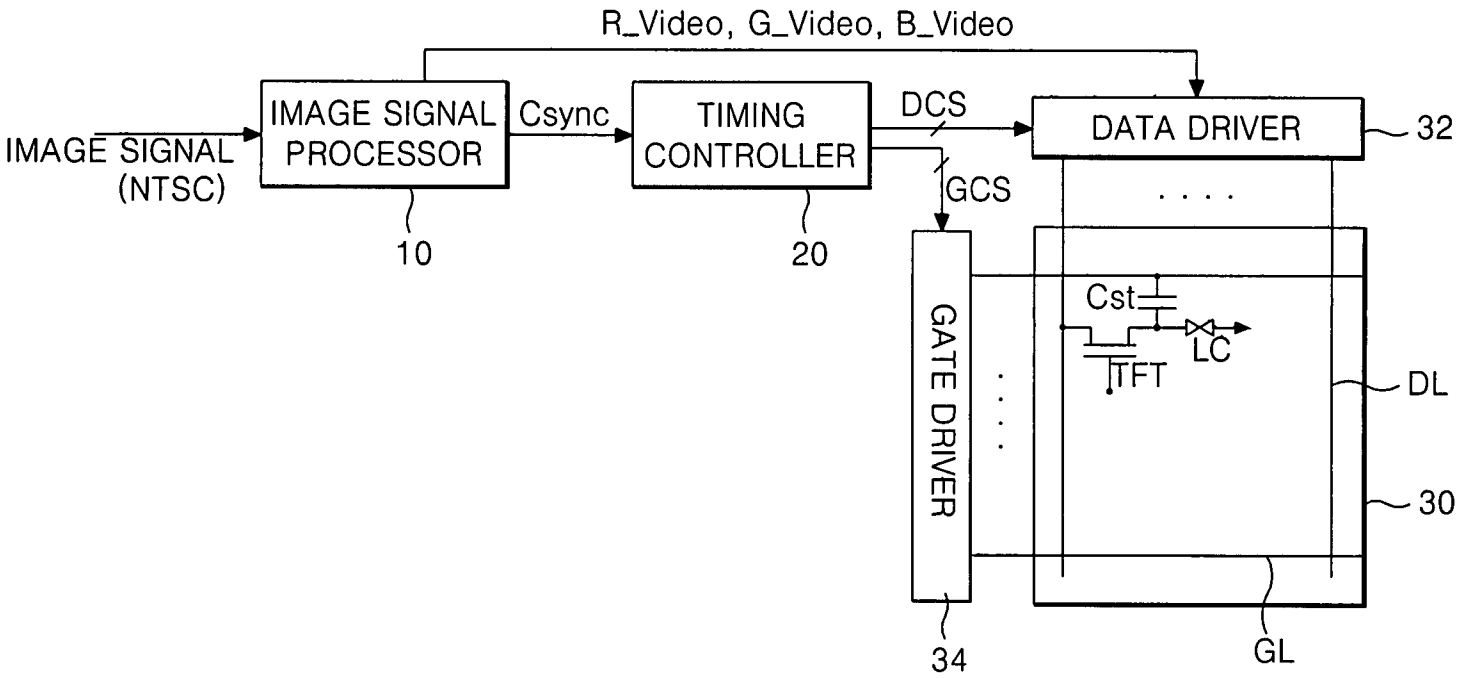
FIG. 1 RELATED ART
FIG. 1 is a schematic block diagram showing a configuration of a conventional driving apparatus for a liquid crystal display in accordance with the related art.
Figure 2:
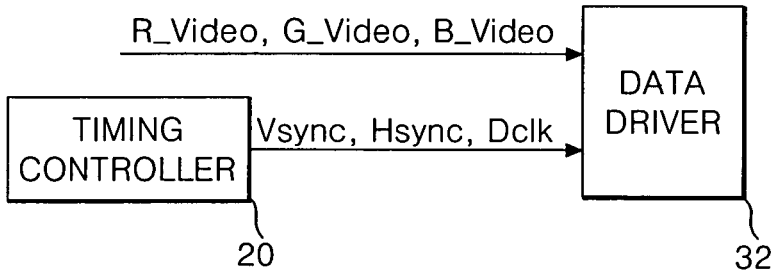
FIG. 2 RELATED ART
FIG. 2 is a block diagram of a timing controller and a data driver shown in FIG. 1 in accordance with the related art.
Figure 3:
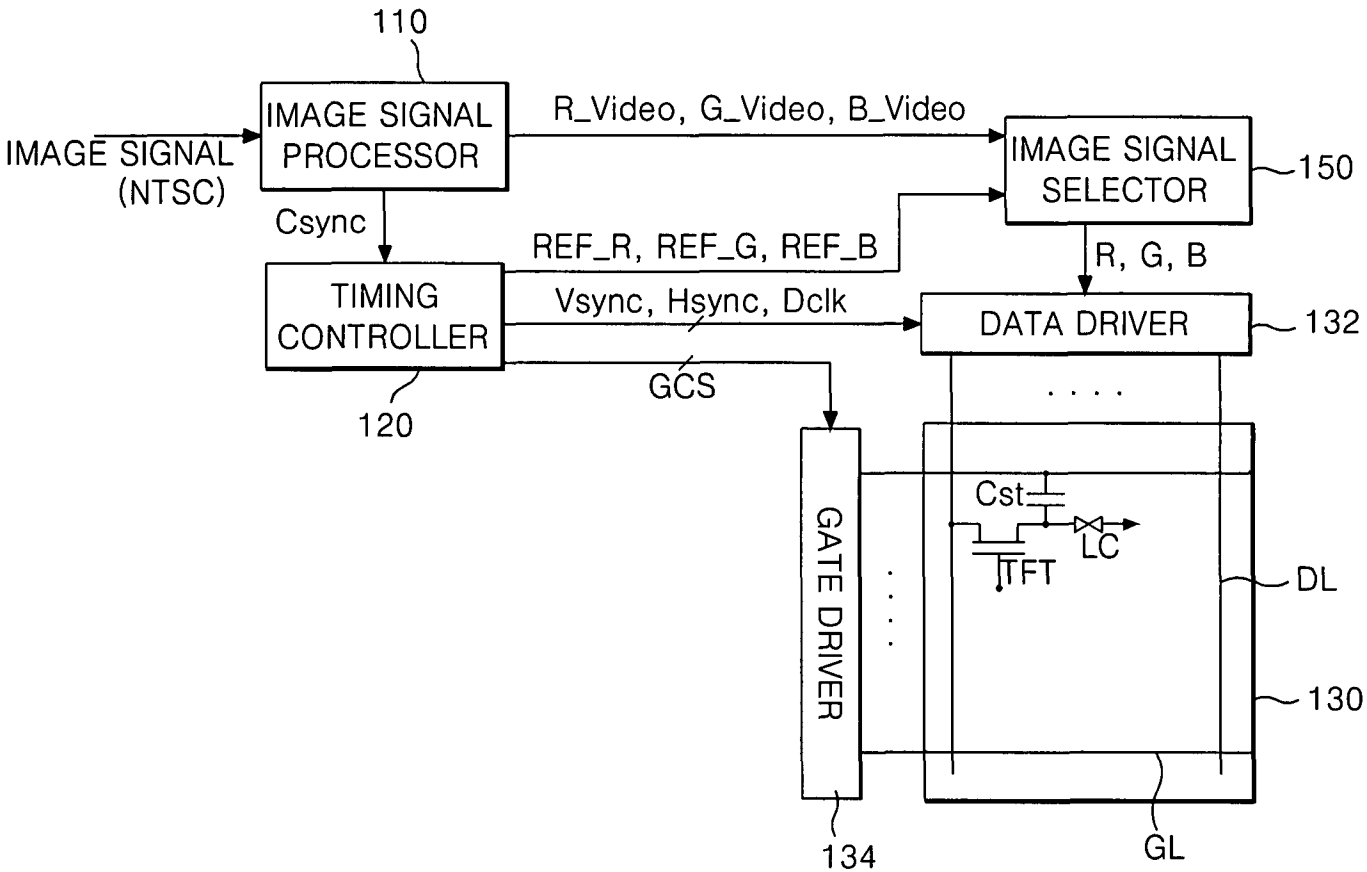
FIG. 3 is a schematic block diagram showing a configuration of a driving apparatus for a liquid crystal display according to an embodiment of the present invention.

Referring to FIG. 3, an LCD driving apparatus according to an embodiment of the present invention includes liquid crystal display panel 130 having liquid crystal cells arranged as a matrix, a gate driver 134 for driving gate lines GL of the liquid crystal display panel 130 and a data driver 132 for driving data lines DL of the liquid crystal display panel 130. The LCD apparatus further includes an image signal processor 110 for extracting a complex synchronizing signal Csync and red, green and blue image signals R_Video, G_Video and B_Video from an input complex image signal NTSC. In addition, the LCD apparatus has a timing controller 120 for controlling the data driver 132 and the gate driver 134 using the complex synchronizing signal Csync from the image signal processor 110. The timing controller 120 generates both an image signal selection signal SEL using the complex synchronizing signal Csync and specific image signals REF_R_ REF_G and REF_B for displaying a specific picture when any image signals R_Video, G_Video and B_Video are not input. The LCD apparatus also comprises an image signal selector 150 for selecting any one of the image signals R_Video, G_Video and B_Video from the image signal processor 110 and the specific image signals REF_R, REF_G and REF_B from the timing controller 120 in response to the image signal selection signal SEL received from the timing controller 120 in order to apply the selected signal to the data driver 132.

The liquid crystal display panel 130 includes liquid crystal cells arranged as a matrix, and thin film transistors TFT provided at crossings between the gate lines GL and the data lines DL for connection with the liquid crystal cells.

The thin film transistor TFT is turned on when a scanning signal such as a gate high voltage VGH from the gate line GL is applied, thereby applying a pixel signal from the data line DL to the liquid crystal cell. Furthermore, the thin film transistor TFT is turned off when a gate low voltage VGL is applied from the gate line GL, thereby maintaining a pixel signal charged in the liquid crystal cell.

It should be noted that the liquid crystal cell may be modelled as a liquid crystal capacitor LC, and may include a pixel electrode connected to a common electrode and the thin film transistor TFT opposed to the pixel electrode with a liquid crystal disposed there between. Further, the liquid crystal cell includes a storage capacitor Cst for stable maintenance of the charged pixel signal until the next pixel is charged. The storage capacitor Cst is disposed between a pre-stage gate line and the pixel electrode. A liquid crystal cell of this type varies an alignment state of the liquid crystal having a dielectric anisotropy in response to a pixel signal charged via the thin film transistor TFT to control a light transmittance, thereby implementing a gray scale level.

The image signal processor 110 converts the complex image signal NTSC into red, green and blue image signals R_Video, G_Video and B_Video such that the image signals are suitable for driving according to properties of the liquid crystal display panel 130. The image signal processor 110 then applies the image signals to the image signal selector 150. In addition, the image signal processor extracts the complex synchronizing signal Csync from the complex image signal NTSC and applies the complex synchronizing signal Csync to the timing controller 120.

Figure 4:
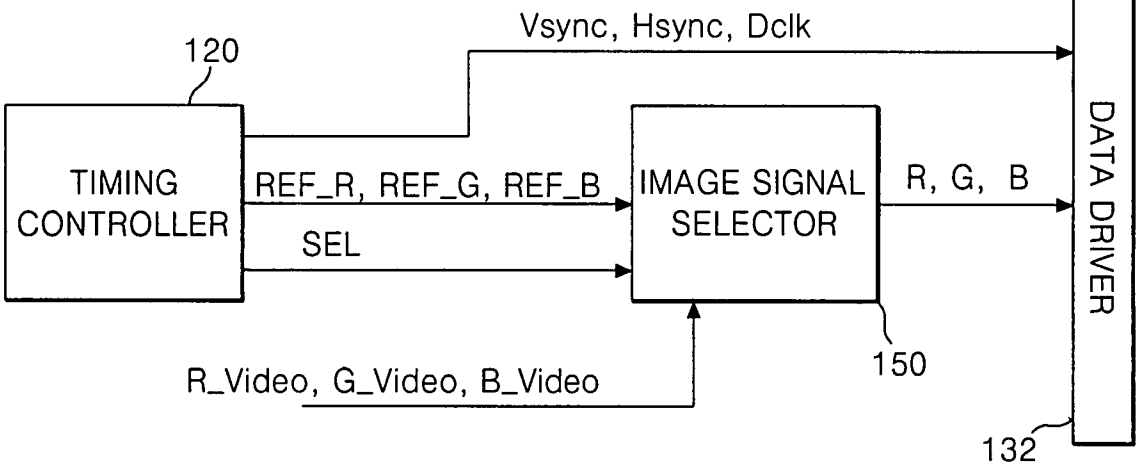
FIG. 4 is a block diagram of a timing controller and an image signal selector shown in FIG. 3.

As shown in FIG. 4, the timing controller 120 generates a horizontal synchronizing signal Hsync, a vertical synchronizing signal Vsync and a dot clock Dclk using the complex synchronizing signal Csync from the image signal processor 110. The timing controller 120 applies the horizontal synchronizing signal Hsync, the vertical synchronizing signal Vsync and the dot clock Dclk to the data driver 132. Further, the timing controller 120 generates a data control signal DCS and applies the data control signal DCS to the data driver 132 for controlling a driving time of the data driver 132. The timing controller 120 also generates a gate control signal GCS and applies the gate control signal GCS to the gate driver 134 with the aid of the horizontal synchronizing signal Hsync, the vertical synchronizing signal Vsync and the dot clock Dclk for controlling a driving time of the gate driver 134.

Figure 5:
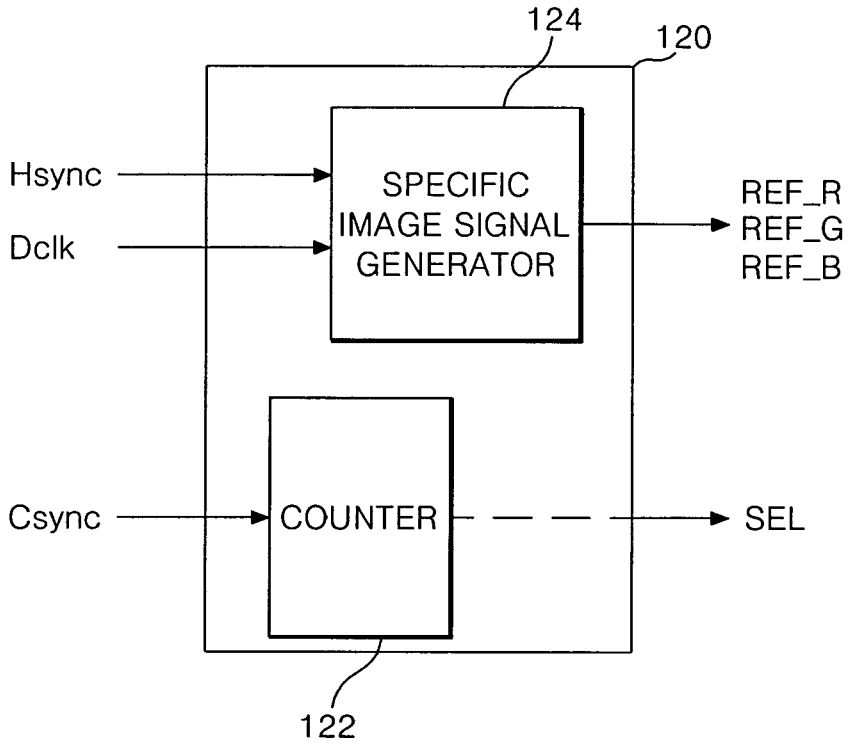
FIG. 5 is a block diagram of a timing controller shown in FIG. 3.

Now making reference to FIG. 5, the timing controller 120 includes a counter 122 for generating the image signal selection signal SEL. The timing controller 120 also has a specific image signal generator 124 for generating the specific image signals REF_R, REF_G and REF_B. In this embodiment, the specific image signal generator 124 may be integrated into the interior of the timing controller 120 or may be separate from the timing controller 120.

The counter 122 generates the image signal selection signal SEL by counting synchronization pulses in the complex synchronizing signal Csync supplied from the image signal processor 110. Additionally, the counter 122 generates an image signal selection signal SEL having a first logic state when the complex synchronizing signal Csync is input at a frequency less than twice of the frequency of REF_R, REF_G and REF_B applied to the image signal selector 150. Moreover, the counter 122 generates an image signal selection signal SEL having a second logic state when the complex synchronizing signal Csync is input at a frequency more than twice the frequency of the REF_R, REF_G and REF_B applied to the image signal selector 150.

Figure 6A:
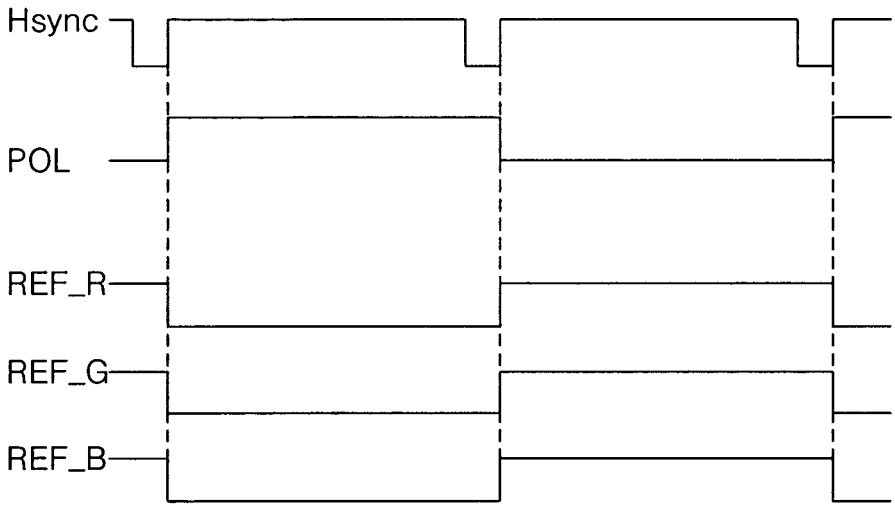
FIG. 6A is a waveform diagram of specific image signals displaying a full black picture generated by a specific image signal generator shown in FIG. 5.
Figure 6B:
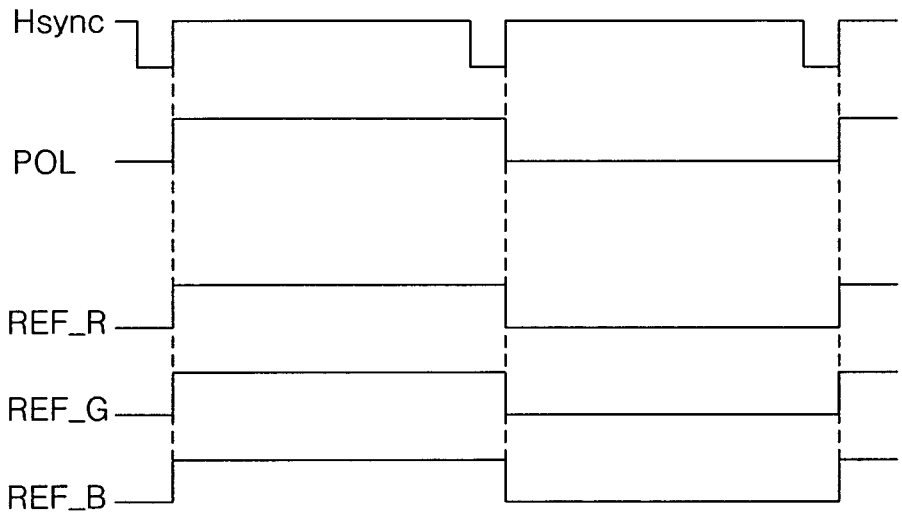
FIG. 6B is a waveform diagram of specific image signals displaying a full white picture generated by the specific image signal generator shown in FIG. 5.
Figure 6C:
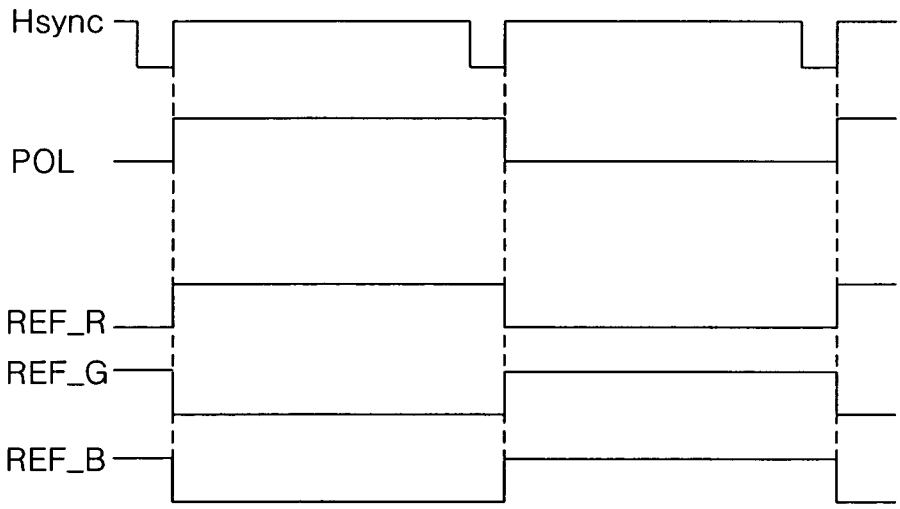
FIG. 6C is a waveform diagram of specific image signals displaying a full red picture generated by the specific image signal generator shown in FIG. 5.
Figure 6D:
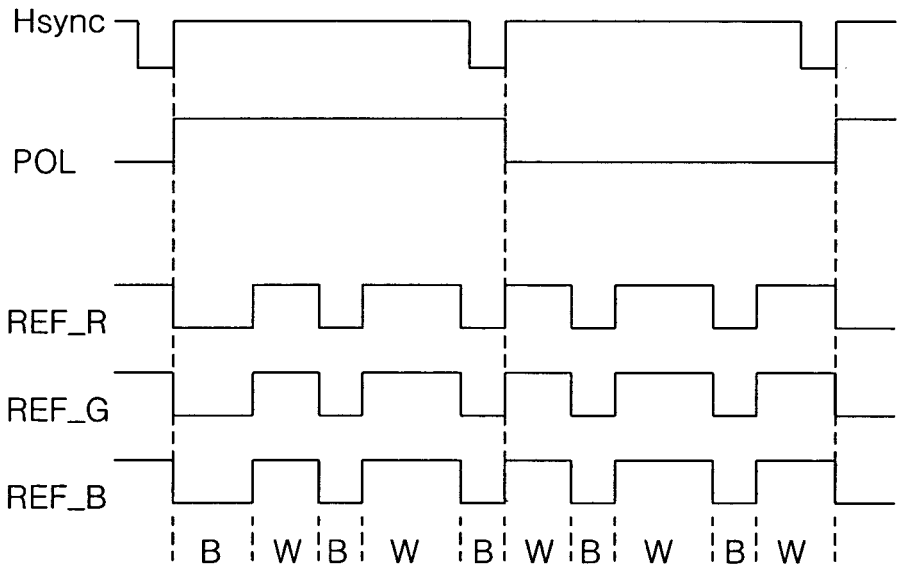
FIG. 6D is a waveform diagram of specific image signals displaying a picture in which a black picture and a white picture are alternatively generated repeatedly by the specific image signal generator shown in FIG. 5.

The specific image signal generator 124 generates specific red, green and blue image signals REF_R, REF_G and REF_B as shown in FIG. 6A to FIG. 6D using the horizontal synchronizing signal Hsync and the dot clock Dclk. A combination of specific red, green and blue image signals REF_R, REF_G and REF_B allows any one of a full black picture as shown in FIG. 6A, a full white picture as shown in FIG. 6B, a full red picture as shown in FIG. 6C and a picture in which a black picture and a white picture are alternately repeated as shown in FIG. 6D to be displayed on the liquid crystal display panel 130. In this embodiment, a picture of the specific red, green and blue image signals REF_R, REF_G and REF_B displayed on the liquid crystal display panel 130 is differentiated in response to a logical state of each of a specific red signal REF_R, a specific green signal REF_G and a specific blue signal REF_B. Additionally, a picture of the specific red, green and blue image signals REF_R, REF_G and REF_B displayed on the liquid crystal display panel 130 has a polarity inverted for each horizontal period by a polarity inversion signal POL. Such specific image signals REF_R, REF_G and REF_B become different from the red, green and blue image signals R_Video, G_Video and B_Video supplied from the image signal processor 110 to the data driver 132.

Figure 7:
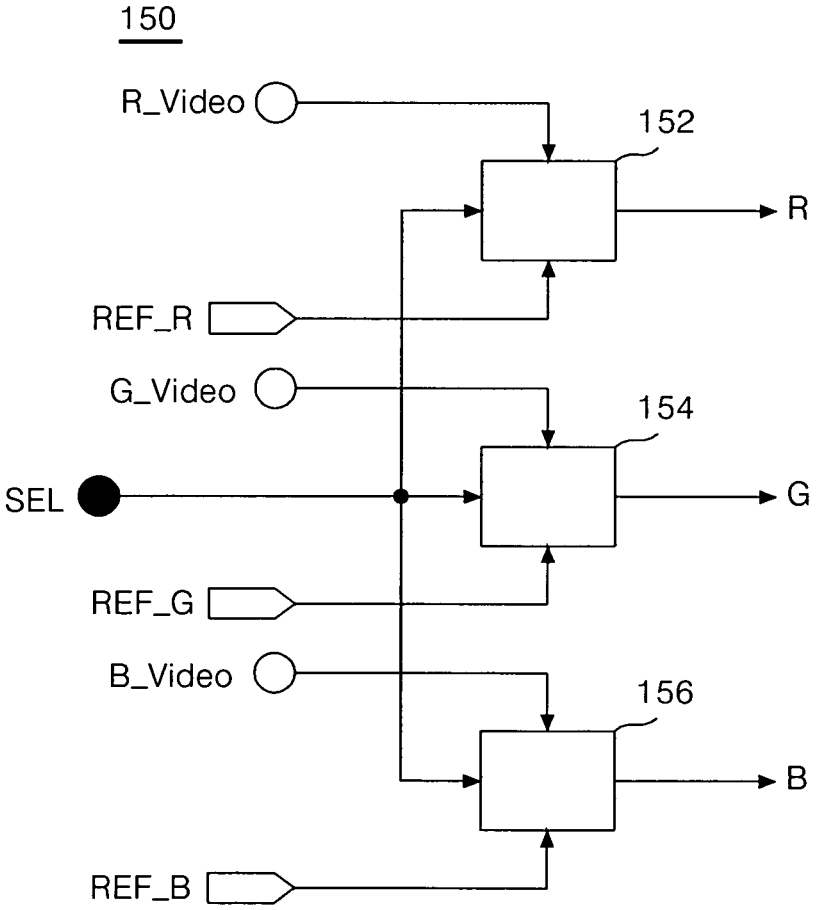
FIG. 7 is a block diagram of an image signal selector shown in FIG. 3.

As shown in FIG. 7, the image signal selector 150 includes a first selection circuit 152 for outputting any one of the red image signal R_Video from the image signal processor 110 and the specific red image signal REF_R from the specific image signal generator 124 in response to the image signal selection signal SEL received from the timing controller 120. The image signal selector 150 also has a second selection circuit 154 for outputting any one of the green image signal G_Video from the image signal processor 110 and the specific green image signal REF_G from the specific image signal generator 124 in response to the image signal selection signal SEL received from the timing controller 120. In addition, the image, signal selector 150 includes a third selection circuit 156 for outputting any one of the blue image signal B_Video from the image signal processor 110 and the specific blue image signal REF_B from the specific image signal generator 124 in response to the image signal selection signal SEL received from the timing controller 120.

When the image signal selection signal SEL from the timing controller 120 has the first logic state, the first to third selection circuits 152, 154 and 156 selectively output the specific red signal REF_G, the specific green signal REF_G and the specific blue signal REF_B supplied from the specific image signal generator 124 of the timing controller 120. Thus, output image signals R, G and B output from the image signal selector 150 to the data driver 132 become the specific image signals REF_R REF_G and REF_B.

Alternatively, when the image signal selection signal SEL from the timing controller 120 has the second logic state, the first to third selection circuits 152, 154 and 156 selectively output the red, green and blue image signals R_Video, G_Video and B_Video supplied from the image signal processor 110. Thus, output image signals R, G and B output from the image signal selector 150 to the data driver 132 become the red, green and blue image signals R_Video, G_Video and B_Video.

The gate driver 134 sequentially applies the gate high voltage VGH to the gate lines GL in response to the gate control signals GSP, GSC and GOE from the timing controller 120. Thus, the gate driver 134 allows the thin film transistors TFT connected to the gate lines GL to be driven for each gate line.

More specifically, the gate driver 134 shifts a gate start pulse GSP in response to a gate shift pulse GSC to generate a shift pulse. Further, the gate driver 134 applies the gate high voltage VGH to the corresponding gate line GL every horizontal period H1, H2, . . . in response to the shift pulse. In an embodiment, the gate driver 134 applies the gate high voltage VGH in an enable period in response to a gate output enable signal GOE. Alternatively, the gate driver 34 applies the gate low voltage VGL in the remaining period when the gate high voltage VGH is not applied to the gate lines GL.

The data driver 132 applies pixel data signals for each line of the data lines DL every horizontal period H1, H2, . . . in response to the horizontal synchronizing signal Hsync, the vertical synchronizing signal Vsync, the dot clock Dclk and data control signals SSP, SSC and SOE from the timing controller 120. Particularly, the data driver 132 converts the output image signals R, G and B from the image signal selector 150 into analog data and applies the analog data to the data lines DL.

More specifically, the data driver 132 shifts a source start pulse SSP from the timing controller 120 in response to a source shift clock SSC to generate a sampling signal. Then, the data driver 132 sequentially inputs the output image signals R, G and B supplied from the image signal selector 150 for each certain unit in response to the sampling signal in order to latch the output image signals R, G and B. Further, the data driver 132 applies the latched analog data for one line to the data lines DL.

An LCD driving apparatus according to an embodiment of the present invention selects the image signals R_Video, G_Video and B_Video from the image signal processor 110 when the image signals R_Video, G_Video and B_Video are supplied from the image signal processor 110. In this embodiment, the image signal selector 150 applies the image signals R_Video, G_Video and B_Video to the data driver 132. Alternatively, an LCD apparatus according to an embodiment of the present invention selects the specific image signals REF_R, REF_G and REF_B from the specific image signal processor 110 generated at the timing controller 120 when the image signals R_Video, G_Video and B_Video are not supplied from the image signal processor 110 to the data driver 132 with the image signal selector 150 such that the signals is applied to the data driver 132.

Accordingly, the LCD driving apparatus according to the present invention allows picture inspection using the specific image signals REF_R, REF_G and REF_B generated from the timing controller 120 when image signals are not applied from the image signal processor 110 to the data driver 132. In particular, when a signal is not applied during a panel aging process in the course of the LCD fabrication process, a user may still perform a picture inspection. Thus, the LCD driving apparatus according to an embodiment of the present invention detects if image signals are input to display a picture inspection pattern on the liquid crystal display panel when no signal is input, thereby decreasing times associated with fabricating a LCD apparatus according to the present invention.

Such a LCD driving apparatus according to an embodiment of the present invention may be used with various self-luminous and non-self-luminous flat panel display devices including a field emission display (FED), a plasma display panel (PDP) and an electro-luminescence (EL) display device, or the like.

As described above, the LCD driving apparatus according to the present invention includes a counter for counting a complex synchronizing signal supplied from an image signal processor to detect if image signals are input, thereby generating the selection signal. In addition, as discussed above, the present invention includes a timing controller having an image signal generator for generating the specific image signals and an image signal selector for selecting the image signals and the specific image signals in response to the selection signal to apply them to the data driver. Accordingly, an LCD driving apparatus according to the present invention facilitates picture inspection using specific image signals when an image signal is not input, thereby decreasing fabrication process times for an LCD apparatus.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a liquid crystal display, comprising:

a liquid crystal display panel;

an image signal processor that extracts a complex synchronizing signal and a first image signal from a complex image signal;

an image signal generator that generates a second image signal using a horizontal synchronizing signal and a dot clock;

an input signal detector that counts pulses in the complex synchronizing signal to decide whether the first image signal from the image signal processor is provided to a data driver or not, and generate a selection signal according to the result of the counting;

an image signal selector that selectively outputs one of the first image signal from the image signal processor and the second image signal from the image signal generator in response to the selection signal;

wherein the data driver applies the selected output image signal to the liquid crystal display panel; and a gate driver that drives a plurality of gate lines in the liquid crystal display panel;

wherein the complex synchronizing signal is used for generating a gate control signal to control the gate driver and a data control signal to control the data driver.

2. The driving apparatus as claimed in claim 1, wherein the input signal detector is a counter to generate a first logical state of a selection signal when the complex synchronizing signal is detected less than twice times while generating a second logical state of a selection signal when the complex synchronizing signal is detected more than twice times.

3. The driving apparatus as claimed in claim 2, wherein the image signal selector includes:

a first selection circuit supplied with a red signal of the first image signal and a red signal of the second image signal;

a second selection circuit supplied with a green signal of the first image signal and a green signal of the second image signal; and a third selection circuit supplied with a blue signal of the first image signal and a blue signal of the second image signal.

4. The driving apparatus as claimed in claim 3, wherein each of the first, second, and third selection circuits selects the second image signal in response to the first logical state of a selection signal and applies the second image signal to the data driver while selecting the first image signal in response to the second logical state of selection signal and applies the first image signal to the data driver.

5. The driving apparatus as claimed in claim 1, wherein the first image signal is different from the second image signal.

6. The driving apparatus as claimed in claim 1, wherein the image signal generator and the input signal detector are built in a timing controller that controls driving timing of the liquid crystal display panel.

7. A method of driving a liquid crystal display, comprising:

extracting a complex synchronizing signal and a first image signal from a complex image signal;

generating a second image signal using a horizontal synchronizing signal and a dot clock;

counting the number of pulses in the complex synchronizing signal to decide whether the first image signal is provided to a data driver or not, and generating a selection signal according to the result of the counting;

selecting one of the first image signal and the second image signal in response to the selection signal using an image signal selector; and applying one of the first selected image signal and the selected second image signal, via the data driver, to a liquid crystal display panel;

wherein the complex synchronizing signal is used for generating a data control signal to control the data driver and a gate control signal to control a gate driver which drives a plurality of gate lines in the liquid crystal display panel.

8. The method as claimed in claim 7, wherein the operation of generating the selection signal includes counting the pulses in the complex synchronizing signal using a counter to generate a first logical state of a selection signal when the complex synchronizing signal is detected less than twice times while generating a second logical state of a selection signal when the complex synchronizing signal is detected more than twice times.

9. The method as claimed in claim 8, wherein the image signal selector selects the second image signal in response to the first logical state of a selection signal and applies the second image signal to the data driver while selecting the first image signal in response to the second logical state of a selection signal to apply the first image signal to the data driver.

10. The method as claimed in claim 7, wherein the first image signal is different from the second image signal.

11. A driving apparatus for a liquid crystal display, comprising:

a liquid crystal display panel;

an image signal processor to extract a complex synchronizing signal and a first image signal from a complex image signal externally input;

a timing controller to generate a second image signal using a horizontal synchronizing signal and a dot clock, and count the pulses in a complex synchronizing signal to decide whether the first image signal from the image signal processor is provided to a data driver or not, and thereby generating a selection signal according to the result of the counting;

an image signal selector to selectively output any one of the first image signal from the image signal processor and the second image signal from the timing controller in response to the selection signal; and a data driver to apply a selected output image signal to the liquid crystal display panel;

a gate driver that drives a plurality of gate lines in the liquid crystal display panel;

wherein the complex synchronizing signal is used for generating a gate control signal to control the gate driver and a data control signal to control the data driver.

12. The driving apparatus as claimed in claim 11, wherein the timing controller includes:

an image signal generator configured to generate the second image signal; and an input signal detector configured to count the pulses in the complex synchronizing signal and generate the selection signal.

13. The driving apparatus as claimed in claim 12, wherein the input signal detector is a counter counting the complex synchronizing signal, the counter being configured to generate a first logical state of a selection signal when the complex synchronizing signal is detected less than twice times.

14. The driving apparatus as claimed in claim 13, wherein the counter is configured to generate a second logical state of a selection signal when the complex synchronizing signal is detected more than twice times.

15. The driving apparatus as claimed in claim 14, wherein the image signal selector includes:

a first selection circuit supplied with a red signal of the first image signal and a red signal of the second image signal;

a second selection circuit supplied with a green signal of the first image signal and a green signal of the second image signal; and a third selection circuit supplied with a blue signal of the first image signal and a blue signal of the second image signal.

16. The driving apparatus as claimed in claim 15, wherein each of the first, second and third selection circuits selects the second image signal in response to the first logical state of a selection signal and applies the second image signal to the data driver while selecting the first image signal in response to the second logical state of selection signal and applies the first image signal to the data driver.

* * * * *